US006146231A

United States Patent [19]

Rachmany

[11] Patent Number: 6,146,231

[45] Date of Patent: Nov. 14, 2000

[54] FLYING TOY

[76] Inventor: Uri Rachmany, 16527 Ballinger St., North Hills, Calif. 91343

[21] Appl. No.: 09/377,115

[22] Filed: Aug. 19, 1999

[51] Int. Cl.[7] ..... A63H 27/127

[52] U.S. Cl. ..... 446/40; 446/36; 446/37; 446/42

[58] Field of Search ..... 446/36, 40, 34, 446/37, 42, 256, 259, 261, 264, 38

[56] References Cited

U.S. PATENT DOCUMENTS

| | | | |
|---|---|---|---|
| 1,313,327 | 8/1919 | Parker et al. | 446/40 |
| 1,340,786 | 5/1920 | Manzie | 446/40 |
| 1,420,449 | 6/1922 | Salvo | 446/40 |
| 1,942,894 | 1/1934 | Holbrook | 446/40 |
| 2,242,770 | 5/1941 | Ayers | 446/40 |
| 3,246,424 | 4/1966 | Gregory | 446/40 |

*Primary Examiner*—Sam Rimell
*Assistant Examiner*—Urszula M. Cegielnik
*Attorney, Agent, or Firm*—Goldstein & Canino

[57] ABSTRACT

A flying toy including a handle portion having an upper end. A spindle is mounted atop the upper end and has a bore extending downwardly therethrough. A rotating rod extends through the bore and into the upper end of the handle to allow relative rotation of the spindle upon the handle. The spindle has a pair of pins extending upwardly therefrom. A propeller portion is coupled with respect to the circular platform of the handle portion. The propeller portion includes an inner circular disk. The inner circular disk has a plurality of radially extending blades integrally formed with a peripheral edge thereof. Each of the blades have a predetermined angle of orientation. A length of string is secured to the spindle. The length of string has an end fixedly secured to the spindle with a remainder of the string being wrappedly disposed around the rotating rod just prior to operation of the toy. Operation involves pulling the string while holding the handle still, to rotate the spindle and cause the propeller portion to rotate and lift upward, free of the spindle.

4 Claims, 2 Drawing Sheets

FLYING TOY

BACKGROUND OF THE INVENTION

The present invention relates to a flying toy and more particularly pertains to manually causing a propeller to raise into the air.

Children are fascinated with toys that can fly in the air. They are constantly making paper airplanes and launching them both indoors and outside. When children are bored with these types of toys, they often demand a toy that is more sophisticated and, unfortunately for parents, more expensive. What is needed is toy that can provide the amusing purposes that will satisfy the child but which does not place a tremendous strain on the parents wallet.

The present invention attempts to solve the aforementioned problem by providing a flying toy that does involve sophisticated circuitry or moving parts, but will be fun and enjoyable for children.

The use of aerodynamic toys is known in the prior art. More specifically, aerodynamic toys heretofore devised and utilized for the purpose of flying in the air are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a flying toy for manually causing a propeller to raise into the air.

In this respect, the flying toy according to the present invention substantially departs from the conventional concepts and designs of the prior art, and in doing so provides an apparatus primarily developed for the purpose of manually causing a propeller to raise into the air.

Therefore, it can be appreciated that there exists a continuing need for new and improved flying toy which can be used for manually causing a propeller to raise into the air. In this regard, the present invention substantially fulfills this need.

SUMMARY OF THE INVENTION

In the view of the foregoing disadvantages inherent in the known types of aerodynamic toys now present in the prior art, the present invention provides an improved flying toy. As such, the general purpose of the present invention, which will be described subsequently in greater detail, is to provide a new and improved flying toy and method which has all the advantages of the prior art and none of the disadvantages.

To attain this, the present invention essentially comprises a handle portion having a generally cylindrical configuration. The handle portion has a rounded lower end and a planar upper end. The planar upper end has a bore extending downwardly therein. The bore has a bushing disposed therein. A rotating rod is disposed within the bushing of the bore. An upper end of the rotating rod has a circular platform secured thereto. The circular platform has a pair of pins extending upwardly therefrom. The pair of pins are diametrically opposed from one another with respect to the circular platform. A propeller portion is coupled with respect to the circular platform of the handle portion. The propeller portion includes an inner circular disk. The inner circular disk has a pair of diametrically opposed apertures therethrough for receiving the pair of pins of the circular platform therein when the propeller portion is positioned atop the circular platform. The inner circular disk has a plurality of radially extending blades integrally formed with a peripheral edge thereof. Each of the blades have a predetermined angle of orientation. A length of string is secured to the rotating rod of the handle portion. The length of string has an inner end fixedly secured to the rotating rod with a remainder of the string being wrappedly disposed around the rotating rod in an operative orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved flying toy which has all the advantages of the prior art aerodynamic toys and none of the disadvantages.

It is another object of the present invention to provide a new and improved flying toy which may be easily and efficiently manufactured and marketed.

It is a further object of the present invention to provide a new and improved flying toy which is of durable and reliable construction.

An even further object of the present invention is to provide a new and improved flying toy which is susceptible of a low cost of manufacture with regard to both materials and labor, and which accordingly is then susceptible of low prices of sale to the consuming public, thereby making such a flying toy economically available to the buying public.

Even still another object of the present invention is to provide a new and improved flying toy for manually causing a propeller to raise into the air.

Lastly, it is an object of the present invention to provide a new and improved flying toy including a handle portion having an upper end. A spindle is mounted atop the upper end and has a bore extending downwardly therethrough. A rotating rod extends through the bore and into the upper end of the handle to allow relative rotation of the spindle upon the handle. The spindle has a pair of pins extending upwardly therefrom. A propeller portion is coupled with respect to the circular platform of the handle portion. The propeller portion includes an inner circular disk. The inner circular disk has a plurality of radially extending blades integrally formed with a peripheral edge thereof. Each of the blades have a predetermined angle of orientation. A length of string is secured to the spindle. The length of string has an end fixedly secured to the spindle with a remainder of the string being wrappedly disposed around the rotating rod just prior to operation of the toy. Operation involves pulling the string while holding the handle still, to rotate the spindle and cause the propeller portion to rotate and lift upward, free of the spindle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
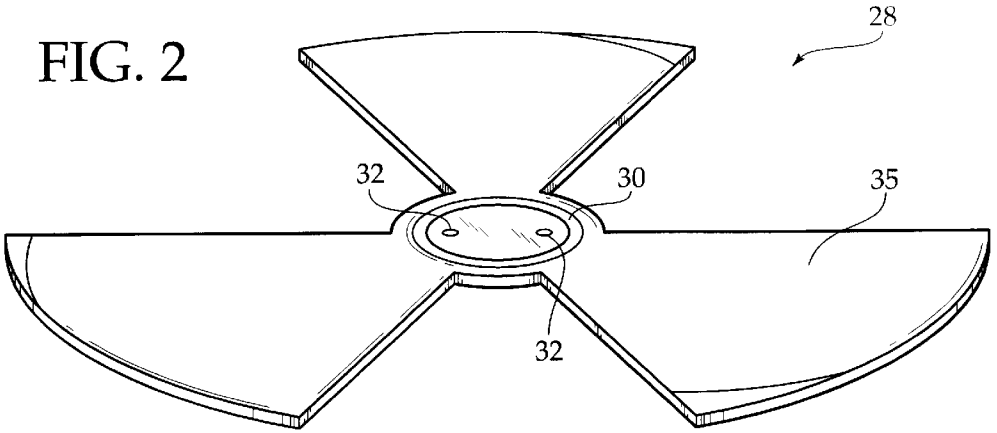
FIG. 2 is a perspective view of the propeller of the present invention.
Figure 3:
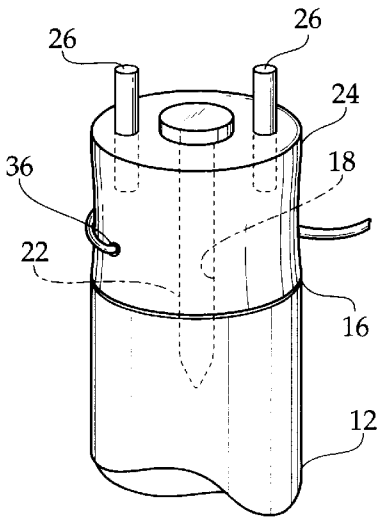
FIG. 3 is a partial perspective view of the upper portion of the handle portion of the present invention.
Figure 1:
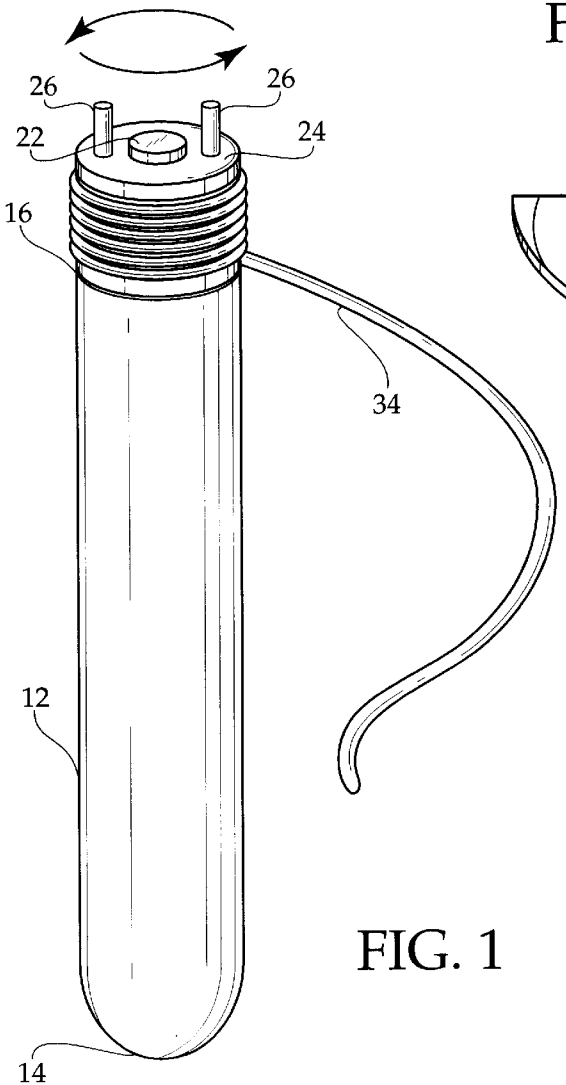
FIG. 1 is a perspective view of the preferred embodiment of the flying toy constructed in accordance with the principles of the present invention.
Figure 4:
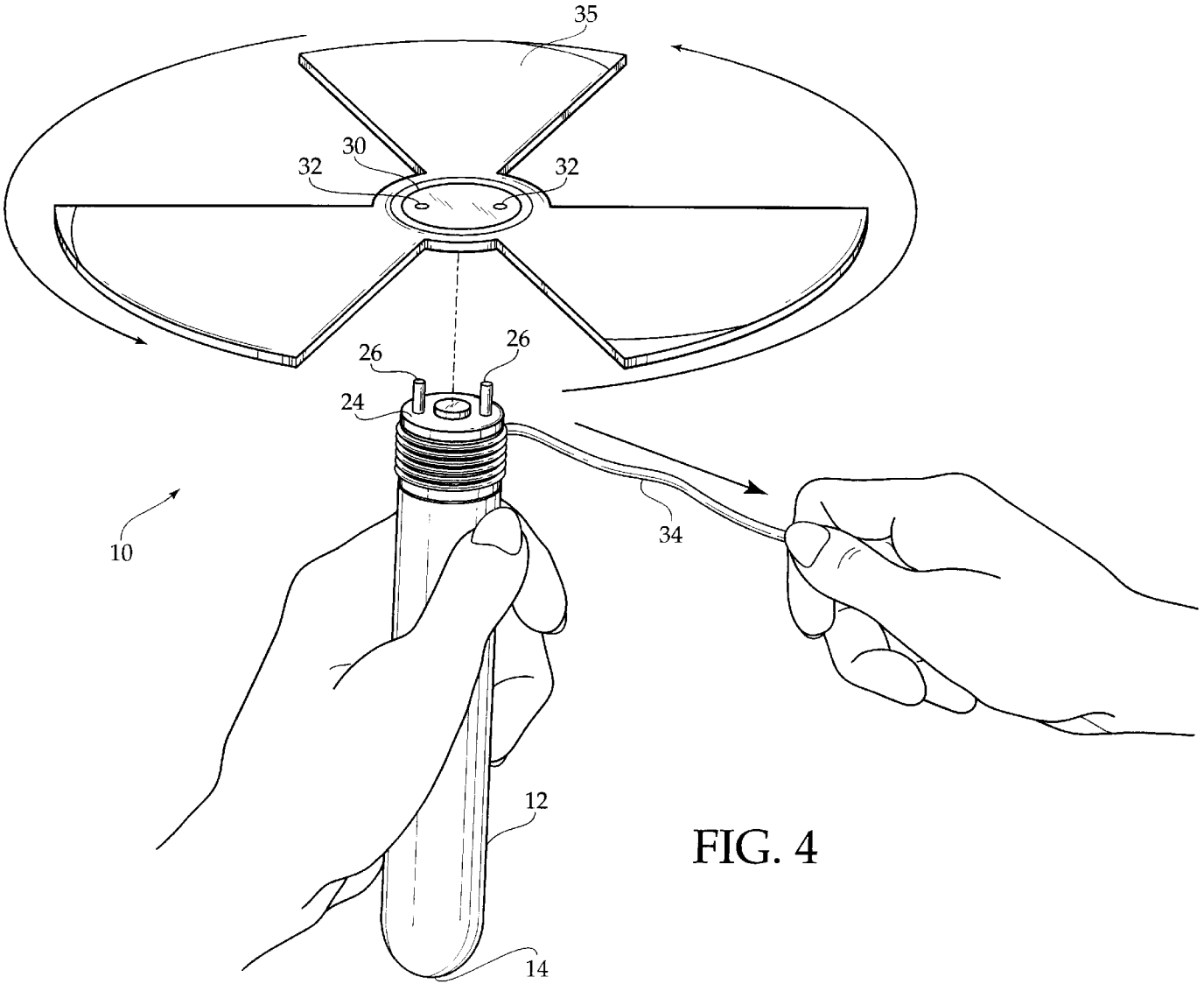
FIG. 4 is a perspective view of the present invention illustrated in use.

With reference now to the drawings, and in particular, to FIGS. 1 through 4 thereof, the preferred embodiment of the new and improved flying toy embodying the principles and concepts of the present invention and generally designated by the reference number 10 will be described.

Specifically, it will be noted in the various Figures that the device relates to a flying toy for manually causing a propeller to raise into the air. In its broadest context, the device consists of a handle portion, a propeller portion, and a length of string. Such components are individually configured and correlated with respect to each other so as to attain the desired objective.

The handle portion 12 has a generally cylindrical configuration. The handle portion 12 has a rounded lower end 14 and a substantially planar upper end 16. A spindle 24 is mounted atop the upper end 16. The spindle 24 is substantially the same in diameter as the handle portion 12 near its upper end 16. The spindle 24 has a bore 18 extending downwardly therethrough. A rotating rod 22 extends through the bore 18 and into the upper end 16 of the handle 12. The rotating rod 22 allows the spindle 24 to rotate with respect to the handle 12. The rotating rod 22 may take the form of a nail extending through the bore 18 and driven partially into the handle 12. If a nail is employed for the rotating rod 22, said nail is not tightly driven into the upper end 16—a small space must be maintained between the upper end 16 and spindle 24, to ensure that the spindle 24 can rotate freely.

The spindle 24 has a pair of pins 26 extending upwardly therefrom. The pair of pins 26 are diametrically opposed from one another with respect to an axis of the spindle 24. The handle portion 12 preferably has a length that is greater that a width of a palm of a person that would be handling the device 10.

A propeller portion 28 is coupled with respect to the spindle 24 of the handle portion 12. The propeller portion 28 includes an inner circular disk 30. The inner circular disk 30 has a pair of diametrically opposed apertures 32 therethrough for receiving the pair of pins 26 of the spindle 24 therein when the propeller portion 28 is positioned atop the circular platform 24. The thickness of the inner circular disk will be less than the length of the pair of pins 26 so that the propeller portion 28 will securely seat on the circular platform 24. The inner circular disk 30 has a plurality of radially extending blades 35 integrally formed with a peripheral edge thereof. Each of the blades 35 have a predetermined angle of orientation. The angle of orientation will determine the flight characteristics of the propeller portion 28. A number of different propeller portions 28 could be included in a set so as to provide a variety of flight for the device 10.

The length of string 34 is secured to the spindle 24. An end of the string 36 is secured to the spindle by any suitable means, including tying, knotting, gluing, etc., with a remainder of the string being wrappedly disposed around the spindle 24 in an operative orientation.

In use, the string 34 is wrapped around the spindle 24. Once completely wrapped around the spindle 24, the user will grasp the handle portion 12 firmly and then pull the string 34 so that it unwinds off of the spindle 24, causing the spindle 24 to rotate rapidly thereby rotating the propeller portion 28. The rotation of the spindle 24, coupled with the orientation of the blades 35, will lift the propeller portion 28 off of the spindle 24, free of the pins 26, and into the air.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A flying toy for manually causing a propeller to raise into the air, comprising in combination:

a handle portion having a generally cylindrical configuration, the handle portion having a lower end and a planar upper end, a spindle mounted above the upper end, the spindle having a bore extending downwardly therethrough, a rotating rod extending through the bore and into the upper end of the handle, the spindle having a pair of pins extending upwardly therefrom, the pair of pins being diametrically opposed from one another with respect to the spindle, the spindle capable of rotating on the rotating rod with respect to the handle;

a propeller portion coupled with respect to the spindle, the propeller portion including an inner circular disk, the inner circular disk having a pair of diametrically opposed apertures therethrough for receiving the pair of pins of the spindle therein when the propeller portion is positioned atop the circular platform, the inner circular disk having a plurality of radially extending blades integrally formed with a peripheral edge thereof, each of the blades having a predetermined angle of orientation;

a length of string secured to the spindle, the length of string having an end fixedly secured to the spindle with a remainder of the string being wrappedly disposed around the spindle in an operative orientation.

2. A flying toy for manually causing a propeller from raising into the air comprising, in combination:

a handle portion having an upper end;

a spindle mounted above the upper end and having a bore extending downwardly therethrough a rotating rod disposed extending through the bore and into the upper end of the handle;

a propeller portion coupled with respect to the spindle, the propeller portion including an inner circular disk, the inner circular disk having a plurality of radially extending blades integrally formed with a peripheral edge thereof, each of the blades having a predetermined angle of orientation;

a length of string secured to the spindle, the length of string having an end fixedly secured to the spindle with a remainder of the string being wrappedly disposed around the spindle in an operative orientation.

3. The flying toy as set forth in claim 2 wherein the rotating rod is a nail extending through the bore and into the upper end of the handle.

4. The flying toy as set forth in claim 2 wherein the platform has a pair of pins extending upwardly therefrom, the pair of pins being received within a pair of apertures in the inner disk of the propeller portion when the propeller portion is positioned atop the circular platform.

* * * * *